US009416575B2

(12) United States Patent
Peer et al.

(10) Patent No.: US 9,416,575 B2
(45) Date of Patent: Aug. 16, 2016

(54) FURNITURE HINGE WITH PLASTIC INSERT

(71) Applicant: Grass America, Inc., Kernersville, NC (US)

(72) Inventors: Manfred Peer, Walkertown, NC (US); Cheng Jiang, Kernersville, NC (US); Georg Domenig, Kernersville, NC (US)

(73) Assignee: Grass America, Inc., Kernersville, NC (US)

( * ) Notice: Subject to any disclaimer, the term of this patent is extended or adjusted under 35 U.S.C. 154(b) by 17 days.

(21) Appl. No.: 14/283,627

(22) Filed: May 21, 2014

(65) Prior Publication Data

US 2015/0337578 A1 Nov. 26, 2015

(51) Int. Cl.

| | |
|---|---|
| ***E05D 5/14*** | (2006.01) |
| ***E05D 15/00*** | (2006.01) |
| ***E05D 3/02*** | (2006.01) |
| ***E06B 3/34*** | (2006.01) |
| ***E05D 11/10*** | (2006.01) |

(52) U.S. Cl.

CPC *E05D 15/00* (2013.01); *E05D 3/02* (2013.01); *E05D 11/1014* (2013.01); *E06B 3/34* (2013.01); *E05D 11/1021* (2013.01); *E05Y 2201/48* (2013.01); *E05Y 2201/484* (2013.01); *E05Y 2800/422* (2013.01); *E05Y 2800/68* (2013.01); *Y10T 16/304* (2015.01); *Y10T 16/537* (2015.01); *Y10T 16/53888* (2015.01); *Y10T 16/543* (2015.01)

(58) Field of Classification Search

CPC ..... E05D 5/14; E05D 5/16; E05D 2005/145; E05D 7/10; E05D 7/1044; E05D 7/1055; E05D 7/1061; E05D 7/1072; E05D 7/1077; E05D 7/12; E05D 7/123; E05D 9/005; E05D 5/046; E05D 5/065; Y10T 16/537

See application file for complete search history.

(56) References Cited

U.S. PATENT DOCUMENTS

| | | | | | |
|---|---|---|---|---|---|
| 11,606 | A | * | 8/1854 | Gates | 16/386 |
| 3,590,420 | A | * | 7/1971 | Salice | 16/335 |
| 3,613,151 | A | * | 10/1971 | Anderson | 16/278 |
| 3,744,086 | A | * | 7/1973 | Salice et al. | 16/302 |
| 3,991,436 | A | * | 11/1976 | Nagase | 16/273 |
| 4,112,543 | A | * | 9/1978 | Rock et al. | 16/307 |
| 4,543,686 | A | * | 10/1985 | Rock et al. | 16/288 |
| 4,894,884 | A | * | 1/1990 | Lautenschlager, Jr. | 16/278 |
| 4,972,546 | A | * | 11/1990 | Lautenschalger et al. | 16/288 |
| 5,316,168 | A | * | 5/1994 | Finch et al. | 379/440 |
| 5,355,557 | A | * | 10/1994 | Cress et al. | 16/286 |
| 5,546,633 | A | * | 8/1996 | Liu | 16/278 |
| 5,604,956 | A | | 2/1997 | Grass | |
| 6,401,298 | B1 | * | 6/2002 | Lenz | 16/335 |
| 6,647,591 | B1 | | 11/2003 | Domenig et al. | |
| 6,996,877 | B2 | | 2/2006 | Booker et al. | |

(Continued)

FOREIGN PATENT DOCUMENTS

WO WO2009094272 * 7/2009

OTHER PUBLICATIONS

U.S. Appl. No. 14/283,664, filed May 21, 2014, Peer et al.

*Primary Examiner* — Jeffrey O Brien
(74) *Attorney, Agent, or Firm* — Burr & Brown, PLLC

(57) ABSTRACT

A hinge is provided, including a hinge arm and a hinge cup connected to one another by a hinge pin at a joint in association with a spring, and an insert provided on the hinge arm at the joint and having an external surface which the spring slidably contacts.

34 Claims, 5 Drawing Sheets

(56) References Cited

U.S. PATENT DOCUMENTS

| | | | | |
|---|---|---|---|---|
| 7,117,561 | B1 | 10/2006 | Domenig et al. | |
| 7,707,689 | B2 * | 5/2010 | Kim | 16/342 |
| 8,214,973 | B2 * | 7/2012 | Salice | 16/286 |
| 8,505,165 | B2 | 8/2013 | Domenig et al. | |
| 8,689,402 | B2 * | 4/2014 | Brunnmayr | 16/296 |
| 2002/0050025 | A1 * | 5/2002 | Salice | 16/254 |
| 2004/0226139 | A1 * | 11/2004 | Salice | 16/286 |
| 2008/0201904 | A1 * | 8/2008 | Salice | 16/319 |
| 2013/0104341 | A1 * | 5/2013 | Kenerly et al. | 16/273 |
| 2013/0167323 | A1 * | 7/2013 | Brunnmayr | 16/50 |

* cited by examiner

FURNITURE HINGE WITH PLASTIC INSERT

FIELD OF THE INVENTION

The present invention relates to hinges for use in connection with furniture, in particular, to a plastic insert for use in a hinge that reduces the noise associated with the operation of the hinge and prolongs the service life of the hinge spring.

BACKGROUND OF THE INVENTION

When furniture, such as cabinets, for example, has movable parts, such as doors, those movable parts are often mounted to the main furniture member using a movable member such as a hinge. While hinges are known in the art, there are some problems associated with conventional hinges that the present invention seeks to solve.

One problem is that because a majority of the components of conventional hinges are made of metal, and the metal components come into mechanical and frictional contact with one another, there can be a significant amount of noise associated with the operation of the hinge during use. Accordingly, it would be desirable to provide a hinge having a member that reduces the noise otherwise associated with the hinge operation.

Another problem is that hinges whose control cam or hinge pin is spring activated tend to experience spring breakage over time due to the high spring loads required to produce the opening and closing forces during hinge operation. This usually leads to hinge replacement as a whole, which can be costly and inconvenient. Accordingly, it would be desirable that to provide a hinge having a spring that is not readily susceptible to such breakage, and which facilitates a longer functional life of the hinge.

U.S. Pat. No. 8,689,402 discloses a furniture hinge including plastic sliding members that fit over the ends of each spring leg to engage the spring on the interior surface and the control cam on the exterior surface. While this solution may alleviate some frictional issues and allegedly prolong the spring life, it is clear that separate sliding members are required for each individual spring leg of the hinge. Not only does this require multiple pieces, but preferably according to the '402 patent, additional lubrication means is provided within interior portions of the sliding members. All of factors increase the cost and complicate the steps for fabrication and installation of the hinge.

In view of the above, it would be desirable to provide a hinge that effectively and simultaneously reduces the noise associated with hinge operation and prolongs the spring life without adding multiple additional parts or increasing the cost and the difficulty of the steps associated with the fabrication and installation of the hinge.

SUMMARY OF THE INVENTION

It is the object of the present invention to provide a hinge including a single member that effectively addresses both of the aforementioned problems by simultaneously reducing the noise associated with hinge operation and prolonging the spring life, without increasing the cost or complicating the steps required for fabrication or installation of the hinge.

According to a first aspect of the present invention, a hinge is provided, comprising a hinge arm and a hinge cup connected to one another by a hinge pin at a joint in association with a spring, and an insert provided on the hinge arm at the joint and having an external surface which the spring slidably contacts. According to this aspect of the present invention, an end of the hinge arm having a bore passing therethrough for receiving the hinge pin at the joint is disposed between the two opposed cylindrical portions of the insert, so that the respective bores are coaxially aligned.

The insert also comprises a planar portion disposed between two transversely opposed cylindrical portions respectively having coaxial central bores. The insert comprises snap-fit means for attaching the insert to the hinge arm, located on one of (i) the cylindrical portions of the insert and (ii) the planar portion of the insert.

It is also preferred that at least a portion of the insert comprises a seat portion extending in the transverse direction for receiving an end portion of the hinge arm. It is also preferred that a portion of the outer peripheral surface of each cylindrical portion is a curved plane defining the external surface on which a leg portion of the spring slidably contacts.

The insert is preferably a single, unitary body made of a plastic material.

The hinge according to the present invention can further comprise a damping mechanism located in the hinge cup to control the closing speed of a movable furniture member, such as a cabinet door, for example, to which the hinge is attached.

According to another aspect of the present invention, a furniture hinge is provided, comprising a hinge arm, a hinge cup, a hinge pin connecting the hinge arm to the hinge cup at a joint, and a plastic insert attached directly to the hinge arm and interposed between the hinge arm and the hinge cup, wherein the hinge pin passes thorough coaxially aligned openings in the hinge cup, the plastic insert, and the hinge arm to define the joint. Preferably, the hinge further comprises a spring having at least one leg associated with the hinge pin.

The plastic insert comprises two transversely opposed cylindrical portions sandwiching a portion of the hinge arm therebetween, and preferably, a portion of an external surface of each of the cylindrical portions of the plastic insert has a curved plane portion proximate the joint.

According to this aspect of the present invention, at least a portion of at least one of the legs of the spring slidably contacts a portion of the external surface of the plastic insert proximate the joint. It is preferred that at least a portion of at least one of the legs of the spring slidably contacts at least one of the curved plane portions of the external surfaces of the cylindrical portions of the plastic insert proximate the joint. It is also preferred that the plastic insert is directly attached to the hinge arm via snap fit members extending therefrom that clip to the hinge arm above the joint.

The furniture hinge according to this aspect of the present invention can further comprise a damping mechanism located in the hinge cup to control the closing speed of the furniture to which the hinge is attached.

BRIEF DESCRIPTION OF THE DRAWINGS

For a better understanding of the nature and objects of the invention, reference should be made to the following detailed description of a preferred mode of practicing the invention, read in connection with the accompanying drawings, in which.

DETAILED DESCRIPTION OF THE INVENTION

Figure 1:
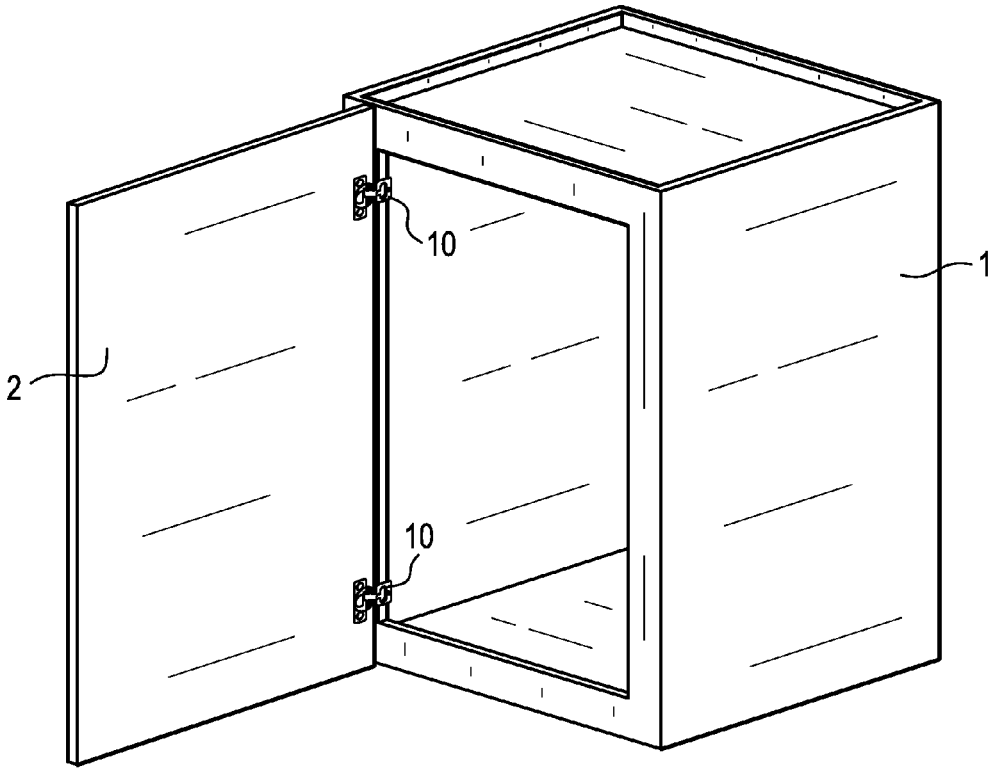
FIG. 1 is a perspective view of a furniture member (i.e., a cabinet) whose door is movably mounted thereto using hinges according to the present invention.
Figure 2:
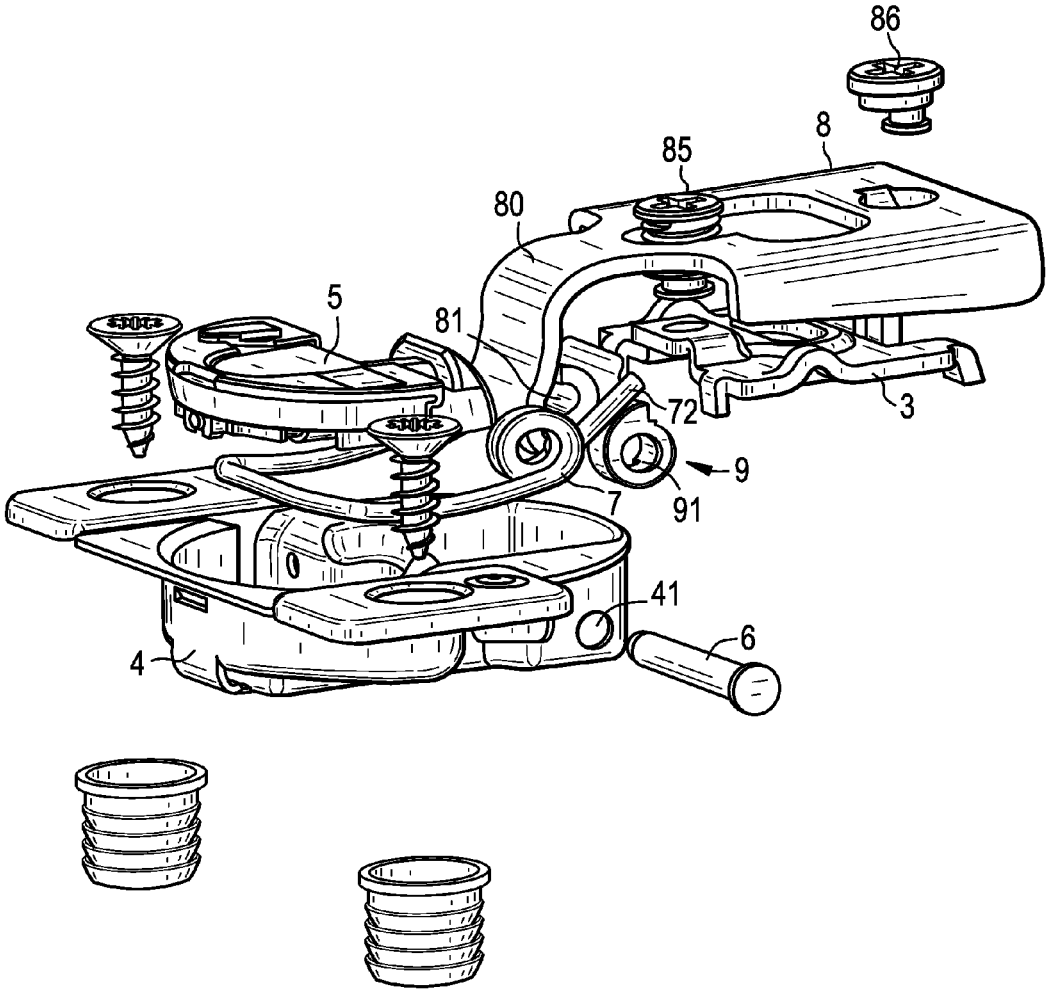
FIG. 2 is an exploded perspective view of a hinge according to the present invention.
Figure 3:
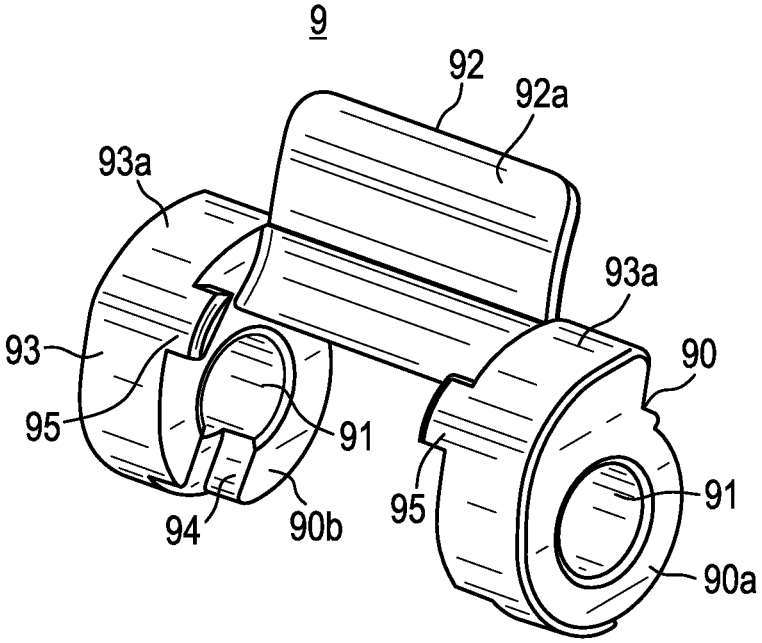
FIG. 3 is a front perspective view of an insert according to one aspect of the present invention.
Figure 4:
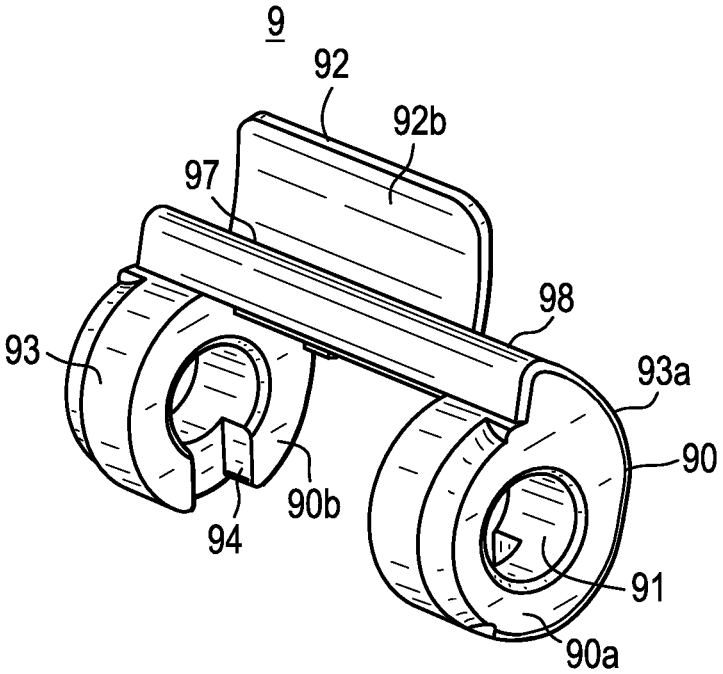
FIG. 4 is a rear perspective view of the insert shown in FIG. 3.
Figure 5:
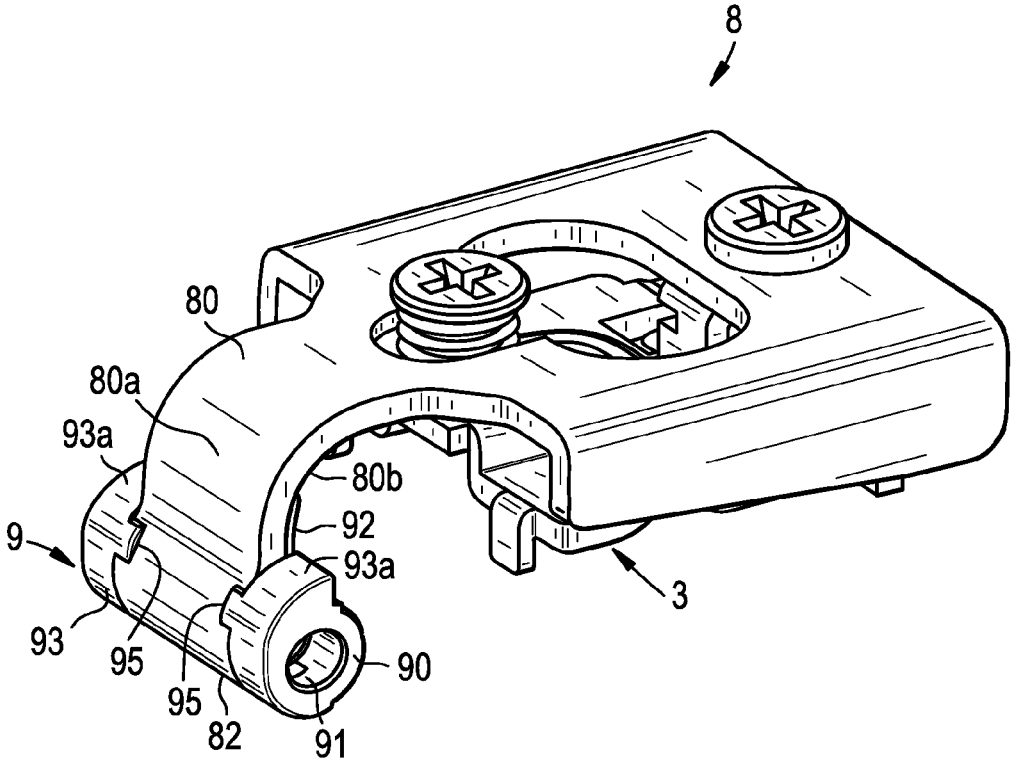
FIG. 5 is a perspective front (joint facing-side) view of the hinge arm and base plate portion of a hinge according to the present invention, showing the insert attached to the lever end of the hinge arm.

FIG. 1 is a perspective view of a furniture piece, such as a cabinet 1, whose movable member, such as door 2, is movably mounted thereto using hinges 10 according to the present invention. FIG. 2 is an exploded perspective front view of a hinge 10 in a pre-assembled state including the plastic insert 9 according to the present invention, and FIG. 5 is a front (joint facing-side) perspective view of the hinge arm 8 and base plate 3 portion of the hinge 10, showing the insert 9 attached to the lever end 80 of the hinge arm 8. FIG. 3 is a front perspective view of the insert 9 and FIG. 4 is a rear perspective view of the insert 9 shown in FIG. 3.

The hinge 10 according to the present invention includes many parts that are typical of hinges, such as a hinge cup 4 which is adapted to be affixed to the movable member of the furniture piece, such as cabinet door 2, and a base plate 3, which is adapted to be fixed to the stationary member of the furniture piece, such as cabinet 1. The hinge arm 8 is adjustably attached to the base plate 3 via the adjustment screw 85 and cam 86. Other examples of hinges that can be fitted with an insert according to the present invention include, but are not limited, to Applicant's U.S. Pat. Nos. 5,604,956, 6,647,591, 6,996,877, and 7,117,561 for example, the entire disclosures of which are incorporated herein by reference.

As shown in FIG. 2, the hinge cup 4 is adapted to be connected to the hinge arm 8 by the hinge pin 6, which passes through coaxially aligned openings or bores 41, 81 in the hinge cup 4 and lever 80 of the hinge arm 8, respectively. However, in the present invention, the insert 9 is also attached directly to and around the end 82 of the lever 80, so that the end 82 of the lever 80 is sandwiched between cylindrical portions 90 of the insert 9 (see e.g., FIG. 5). The openings 91 in the cylindrical portions 90 of the insert 9 are disposed on the opposed lateral sides of the lever 80 and are coaxially aligned with the opening 81 of the lever 80, so that the hinge pin 6 passes through the opening 41 in the hinge cup 4, then the opening 91 in the insert 9 before passing through the lever opening 81, the other insert opening 91 and back though the opening 41 at the opposite side of the hinge cup 4.

The hinge 10 also includes a spring 7 which acts in association with the hinge pin 6 to control the opening and closing force of the hinge 10 in the known manner. In the present invention, however, the leg 72 of the spring 7 slidably contacts an external surface 93 of the insert 9 proximate the joint at the hinge pin 6. For example, the leg 72 of the spring 7 is preferably slidably situated on the surface 93*a* (see FIGS. 2 and 3) of the insert 9 once the hinge 10 is in the assembled state.

Any suitable plastic material can be used for the insert 9. Preferably, the plastic is a thermoplastic material or another polymeric material, for example. The insert 9 can be formed by any known plastic forming technique, suitable examples of which include, but are not limited to, injection molding and die casting, for example. These materials and methods are readily available and inexpensive, making the ease of manufacture high and cost of providing the insert 9 low.

The positioning of the insert 9 in between the metal members (i.e., the hinge pin 6, the lever 80, and the hinge cup 4) at the joint facilitates the noise reduction feature attributable to the present invention by virtue of the fact that the insert 9 is made of a plastic material. The plastic material reduces the friction or abrasion of metal-on-metal at the joint caused by the operation of the hinge, and the sound damping quality provided by the plastic material further lessens the effects of any residual noises. The structure of the hinge joint also enables simplification of the production process.

As shown in FIGS. 3 and 4, the insert 9 includes a planar portion 92 disposed between the two transversely (i.e., laterally) opposed cylindrical portions 90 having the coaxial central bores (i.e., the openings 91) on one side, and a lip portion (i.e., ridge) 98 extending from a peak point of a planar curved portion of one cylindrical portion 90 transversely toward the peak point of the planar curved portion of the opposed cylindrical portion 90 on the opposed side. The planar portion 92 extends from and between the inner lateral surfaces 90*b* of the respective cylindrical portions 90. The planar portion 92 and the lip portion 98 are separated from one another by a trough 97 defining a seat. When installed on the lever 80, the front surface 92*a* of the planar portion 92 faces the back surface 80*b* of the lever 80, and the opposed surface 92*b* of the planar portion faces away from the joint (see FIGS. 3-5).

As shown in FIG. 4, the seat portion 97 extends in the transverse (lateral) direction and is adapted to receive an end portion 82 of the lever 80 of the hinge arm 8 on the opposed side 92*b* facing away from the joint. This facilitates a secure connection with the end 82 of the lever 80 of the hinge arm 8. The snap-fit connection between the insert 9 and the lever 80 of the hinge arm 8 is also further secured by virtue of the snap fit members 95 that extend from the outer surface 93 of the cylindrical portions 90 in the lateral (transverse) direction toward one another to contact the lever 80 sandwiched therebetween, as shown in FIGS. 3-5.

FIGS. 2-5 also show the portion of the outer peripheral surface 93 of each cylindrical portion 90 of the insert 9 having a curved plane shape defining the external surface 93*a* on which at least a the spring leg 72 is slidably situated proximate the joint of the hinge pin 6. Since the insert 9 preferably has a symmetrical shape, as shown in the accompanying drawings, the external surfaces (e.g., 93*a*) of the insert 9 that the spring legs 72 contact are located on laterally (transversely) opposed sides of the joint corresponding to the locations of the respective spring legs, such as spring legs 72 when the spring 7 has a U-shape, as shown in FIG. 2, for example. If a pair of separated springs is used instead, or if another suitable spring configuration is used, the sliding surfaces provided by the insert 9 according to the present invention can still accommodate the arrangement to provide a suitable sliding surface along with the desired function in conjunction with the hinge pin.

The sliding contact between the spring and the insert 9 proximate the hinge pin joint not only reduces the noise associated with hinge operation, but also facilitates proper spring in connection with the hinge pin while reducing the damage caused by metal-on-metal wear and friction, thus prolonging the life of the spring 7 and the functional life of the hinge 10.

The cylindrical portions 90 of the insert 9 are also provided with notches 94 formed on the inner lateral surface 90*b* near the bottom. The notches 94 are mechanical means provided to assist in the assembly of the insert 9 onto the lever 80 in connection with its location in the hinge joint region. The outer lateral surface 90*a* of the cylindrical portion 90 is substantially parallel to the inner surface 90*b* and defines a peripheral portion of the curved plane shape proximate 93*a* and an edge of the outer peripheral surface 93, as shown in FIGS. 3-5.

The insert 9' according to another embodiment of the present invention shares many similar features as the insert 9. For example, the insert 9' shown in FIGS. 6 and 7 includes a planar portion 902 disposed between the two transversely (i.e., laterally) opposed cylindrical portions 900 having coaxial central bores (i.e., the openings 901) on one side, and a lip portion (i.e., ridge) 908 extending from a peak point of a planar curved portion 903*a* of one cylindrical portion 900 transversely toward the peak point of the planar curved portion 903*a* of the opposed cylindrical portion 900 on the opposed side. The planar portion 902 extends between and from the inner lateral surfaces 900*b* of the respective cylindrical portions 900. The planar portion 902 and the lip portion 908 are separated from one another by a trough 907 defining a seat. When installed on the lever 80, the front surface 902*a* of the planar portion 902 faces the back surface 80*b* of the lever 80, and the opposed surface 902*b* faces away from the joint in the same manner as the insert 9 described in connection with FIGS. 3-5.

Figure 6:
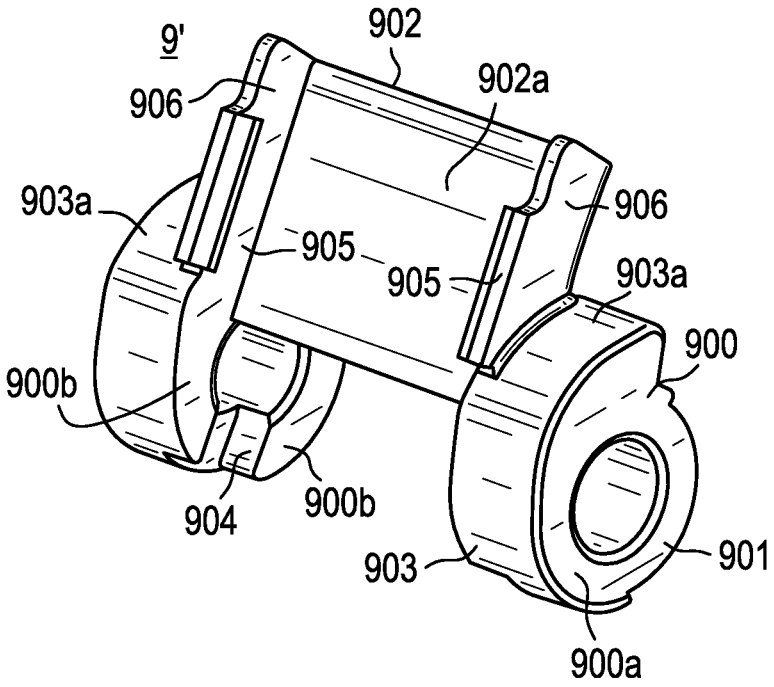
FIG. 6 is a front perspective view of an insert according to another embodiment of the present invention.
Figure 7:
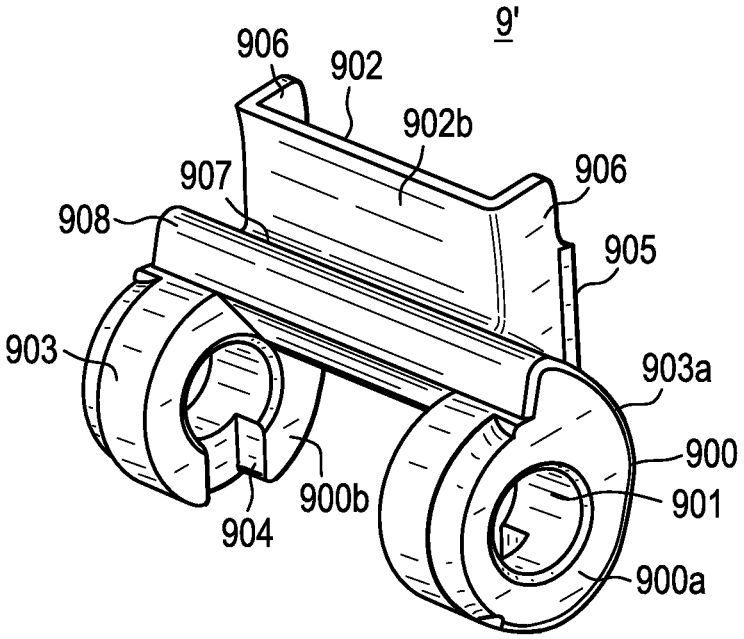
FIG. 7 is a rear perspective view of the insert shown in FIG. 6.

As shown in FIG. 7, the seat portion 907 extends in the transverse (lateral) direction and is adapted to receive an end portion 82 of the lever 80 of the hinge arm 8 on the opposed side 902*b* facing away from the joint. This facilitates a secure connection with the end 82 of the lever 80 of the hinge arm 8. However, as shown in FIGS. 6 and 7, unlike the insert 9, sidewalls 906 extend from the front surface 902*a* of the planar portion 902 of the insert 9' and along a portion of the external surface (outer peripheral surface) 903 of the cylindrical portions proximate the curved plane portions 903*a*. Snap-fit means 905 extend from the sidewalls 906 in a substantially perpendicular manner in the transverse (lateral) direction toward one another, which together serve to securely attach the insert 9' to the lever 80 of the hinge arm 8 in a snap-fit manner.

Similar to the insert 9, a portion of the outer peripheral surface 903 of each cylindrical portion 900 of the insert 9' has a curved plane shape defining a portion of the external surface 903*a* on which at least the spring leg 72 is slidably situated proximate the joint of the hinge pin 6. The insert 9' also preferably has a symmetrical shape, as shown in FIGS. 6 and 7 and discussed above in connection with the insert 9, so that the external surfaces (e.g., 903*a*) of the insert 9' that the spring legs 72 contact are located on laterally (transversely) opposed sides of the joint corresponding to the locations of the respective spring legs in the assembled state.

Also like the insert 9 described in connection with FIGS. 3-5, the cylindrical portions 900 of the insert 9' are also provided with notches 904 formed on the inner lateral surface 900*b* near the bottom. The notches 904 are mechanical means provided to assist in the assembly of the insert 9' onto the lever 80 in connection with its location in the hinge joint region. The outer lateral surface 900*a* of the cylindrical portion 900 is substantially parallel to the surface 900*b* and defines a peripheral portion of the curved plane shape proximate 903*a* and an edge of the outer peripheral surface 903, as shown in FIGS. 6 and 7. The insert 9' functions in the same manner as the insert 9 to reduce noise and prolong spring life.

Preferably, the inserts 9, 9' according to the present invention are a single, unitary body. It should be noted, however, that the inserts can be formed as two or more separate bodies that are snap-fit together, for example, or otherwise joined to then define a single body prior to assembly in the hinge 10. Since the insert 9 (or 9') is a single piece when assembled to form the hinge, the two-fold benefits attributable to the present invention can be realized without the need for adding multiple pieces in different locations within the hinge structure. The hinge 10 can be assembled in an easy fashion by including the snap-fit insert member in the assembly steps as described above, without complicating the manufacture of the hinge 10 or complicating the later installation thereof in the furniture. If necessary, an existing in situ hinge can be removed and retrofitted with the insert according to the present invention with relative ease once the hinge is partially disassembled, and then reassembled and installed.

As also shown in FIG. 2, the hinge 10 according to the present invention can further include a damping mechanism 5, positioned in the hinge cup 4, to control the closing speed of a movable furniture member to which the hinge is attached (i.e., the cabinet door 2). One example of a suitable damping mechanism that can be used is disclosed in Applicant's U.S. Pat. No. 8,505,165, the entire disclosure of which is incorporated herein by reference.

The present invention solves the noise and spring breakage problems associated with conventional hinges by providing a hinge including a single member in the form of a plastic insert that is directly attached to the lever of the hinge arm that simultaneously reduces the noise associated with hinge operation and prolongs the spring life, without significantly increasing the costs or complicating the required steps for fabrication or installation of the hinge.

While the present invention has been particularly shown and described with reference to the preferred mode as illustrated in the drawings, it will be understood by one skilled in the art that various changes in detail may be effected therein without departing from the spirit and scope of the invention as defined by the claims.

What is claimed:

1. A hinge comprising:

a hinge arm and a hinge cup connected to one another by a hinge pin at a joint in association with at least one spring; and an insert provided on the hinge arm at the joint and having an external surface which the spring slidably contacts;

wherein the insert comprises a planar portion extending in a transverse direction, spanning a distance between two transversely opposed cylindrical portions respectively having coaxial central bores; and wherein the insert further comprises opposed, snap-fit members, extending transversely toward one another from respective outer surfaces of the two opposed cylindrical portions, for attaching the insert to a portion of the hinge arm disposed between the two opposed cylindrical portions.

2. The hinge according to claim 1, wherein an end of the hinge arm having a bore passing therethrough for receiving the hinge pin at the joint is disposed between the two opposed cylindrical portions of the insert, so that the respective bores are coaxially aligned.

3. The hinge according to claim 1, wherein at least a portion of the insert further comprises a seat portion extending in the transverse direction between the two opposed cylindrical portions.

4. The hinge according to claim 1, wherein a portion of an outer peripheral surface of each cylindrical portion has a flattened curved surface portion, whose shape deviates from the cylindrical shape of the surface of the cylindrical portion, defining an external surface of the insert on which a leg portion of the spring slidably contacts.

5. The hinge according to claim 1, wherein the insert is a single, unitary body.

6. The hinge according to claim 1, wherein the insert is a plastic material.

7. The hinge according to claim 1, further comprising a damping mechanism located in the hinge cup to control the closing speed of a furniture member to which the hinge is attached.

8. A furniture piece comprising:

a furniture body member; and at least one movable member connected to the furniture body member via at least one hinge according to claim 1.

9. A furniture hinge comprising:

a hinge arm;

a hinge cup;

a hinge pin connecting the hinge arm to the hinge cup at a joint; and a plastic insert attached directly to the hinge arm and interposed between the hinge arm and the hinge cup, the plastic insert comprising two opposed cylindrical portions separated by a substantially flat planar portion extending therebetween in a transverse direction, the opposed cylindrical portions having coaxially aligned central bores defining coaxially aligned openings of the plastic insert;

wherein the plastic insert is directly attached to the hinge arm via opposed snap-fit members, extending transversely toward one another from respective outer surfaces of the opposed cylindrical portions of the insert, wherein the opposed snap-fit members clip to the hinge arm above the joint; and wherein the hinge pin passes thorough the coaxially aligned openings in the plastic insert and through coaxially aligned openings in the hinge cup and the hinge arm to define the joint.

10. The furniture hinge according to claim 9, further comprising at least one spring associated with the hinge pin.

11. The furniture hinge according to claim 10, wherein the two opposed cylindrical portions of the plastic insert sandwich a portion of the hinge arm therebetween.

12. The furniture hinge according to claim 10, wherein a portion of an external surface of each of the cylindrical portions of the plastic insert defines a flattened curved surface portion, whose shape deviates from the cylindrical shape of the cylindrical portions, proximate the joint.

13. The furniture hinge according to claim 10, wherein at least a portion of a leg of the spring slidably contacts a portion of an external surface of the plastic insert proximate the joint.

14. The furniture hinge according to claim 12, wherein at least a portion of a leg of the spring slidably contacts at least one of the flattened curved surface portions of the external surfaces of the cylindrical portions of the plastic insert proximate the joint.

15. The furniture hinge according to claim 9, further comprising a damping mechanism located in the hinge cup to control the closing speed of a movable member of a furniture piece to which the hinge is attached.

16. The furniture hinge according to claim 10, wherein the plastic insert is a single, unitary body.

17. A furniture piece comprising:

a furniture body member; and at least one movable member connected to the furniture body member via at least one furniture hinge according to claim 9.

18. A hinge comprising:

a hinge arm and a hinge cup connected to one another by a hinge pin at a joint in association with at least one spring; and an insert provided on the hinge arm at the joint and having an external surface which the spring slidably contacts;

wherein the insert comprises a planar portion extending in a transverse direction, spanning a distance between two transversely opposed cylindrical portions respectively having coaxial central bores; and wherein the insert further comprises opposed, snap-fit members, extending transversely toward one another from respective opposed sidewall portions of the planar portion, for attaching the insert to a portion of the hinge arm disposed between the two opposed cylindrical portions.

19. The hinge according to claim 18, wherein an end of the hinge arm having a bore passing therethrough for receiving the hinge pin at the joint is disposed between the two opposed cylindrical portions of the insert, so that the respective bores are coaxially aligned.

20. The hinge according to claim 18, wherein at least a portion of the insert further comprises a seat portion extending in the transverse direction between the two opposed cylindrical portions.

21. The hinge according to claim 18, wherein a portion of an outer peripheral surface of each cylindrical portion has a flattened curved surface portion, whose shape deviates from the cylindrical shape of the surface of the cylindrical portion, defining an external surface of the insert on which a leg portion of the spring slidably contacts.

22. The hinge according to claim 18, wherein the insert is a single, unitary body.

23. The hinge according to claim 18, wherein the insert is a plastic material.

24. The hinge according to claim 18, further comprising a damping mechanism located in the hinge cup to control the closing speed of a furniture member to which the hinge is attached.

25. A furniture piece comprising:

a furniture body member; and at least one movable member connected to the furniture body member via at least one hinge according to claim 18.

26. A furniture hinge comprising:

a hinge arm;

a hinge cup;

a hinge pin connecting the hinge arm to the hinge cup at a joint; and a plastic insert attached directly to the hinge arm and interposed between the hinge arm and the hinge cup, the plastic insert comprising two opposed cylindrical portions separated by a substantially flat planar portion extending therebetween in a transverse direction, the opposed cylindrical portions having coaxially aligned central bores defining coaxially aligned openings of the plastic insert;

wherein the plastic insert is directly attached to the hinge arm via opposed snap-fit members, extending transversely toward one another from respective opposed sidewall portions of the planar portion, wherein the opposed snap-fit members clip to the hinge arm above the joint; and wherein the hinge pin passes thorough the coaxially aligned openings in the plastic insert and through coaxially aligned openings in the hinge cup and the hinge arm to define the joint.

27. The furniture hinge according to claim 26, further comprising at least one spring associated with the hinge pin.

28. The furniture hinge according to claim 27, wherein the two opposed cylindrical portions of the plastic insert sandwich a portion of the hinge arm therebetween.

29. The furniture hinge according to claim 27, wherein a portion of an external surface of each of the cylindrical portions of the plastic insert defines a flattened curved surface portion, whose shape deviates from the cylindrical shape of the cylindrical portions, proximate the joint.

30. The furniture hinge according to claim 27, wherein at least a portion of a leg of the spring slidably contacts a portion of an external surface of the plastic insert proximate the joint.

31. The furniture hinge according to claim 29, wherein at least a portion of a leg of the spring slidably contacts at least one of the flattened curved surface portions of the external surfaces of the cylindrical portions of the plastic insert proximate the joint.

32. The furniture hinge according to claim 26, further comprising a damping mechanism located in the hinge cup to control the closing speed of a movable member of a furniture piece to which the hinge is attached.

33. The furniture hinge according to claim 27, wherein the plastic insert is a single, unitary body.

34. A furniture piece comprising:

a furniture body member; and at least one movable member connected to the furniture body member via at least one furniture hinge according to claim 26.

* * * * *